United States Patent [19]

Shimizu et al.

[11] Patent Number: 4,755,853

[45] Date of Patent: Jul. 5, 1988

[54] CLEANING DEVICE

[75] Inventors: Shigeru Shimizu; Masaaki Dohi; Yoji Kuriyama, all of Tokyo, Japan

[73] Assignees: Casio Computer Co., Ltd.; Casio Electronics Manufacturing Co., Ltd., both of Tokyo, Japan

[21] Appl. No.: 776,153

[22] Filed: Sep. 13, 1985

[30] Foreign Application Priority Data

Sep. 20, 1984 [JP] Japan ..... 59-195663

[51] Int. Cl.[4] ..... G03G 21/00

[52] U.S. Cl. ..... 355/15; 15/256.52; 118/652

[58] Field of Search ..... 355/15, 3 R; 15/1.5, 15/256.51, 256.52; 118/652

[56] References Cited

U.S. PATENT DOCUMENTS

| | | | |
|---|---|---|---|
| 3,580,673 | 5/1971 | Yank et al. | 355/15 |
| 4,361,922 | 12/1982 | Karal | 355/15 X |
| 4,451,139 | 5/1984 | Yanagawa et al. | 355/15 |
| 4,482,244 | 11/1984 | Yamazaki et al. | 355/15 |
| 4,506,975 | 3/1985 | Shukuri et al. | 355/15 |
| 4,515,467 | 5/1985 | Suzuki | 355/15 |
| 4,533,236 | 8/1985 | Garsin | 355/15 |

*Primary Examiner*—R. L. Moses

*Attorney, Agent, or Firm*—Sandler & Greenblum

[57] ABSTRACT

The present invention relates to a cleaning apparatus for use in a photocopying apparatus. The cleaning device comprises a grounded conductive fur brush for removing residual toners on a photosensitive drum and a conductive retrieval roll for retrieving the toners caught in the fur brush, a predetermined bias voltage being applied to conductive retrieval roll. The cleaning device further includes a scraping means for scraping the toner transferred to said conductive retrieval roll.

14 Claims, 6 Drawing Sheets

CLEANING DEVICE

BACKGROUND OF THE INVENTION

1. Field of the Invention

The present invention relates to a cleaning device for use with the electrophotographic copying machine and the like.

2. Prior Art

As the cleaning device for use with the electrophotographic copying machine and the like, there have been well known in the art those of the magnetic brush type, of the blade type, of the fur brush type and of the other types.

The one of the magnetic brush type is intended to absorb and eliminate residual particles of toner from the surface of a photosenstive body in such a way that a non-magnetic cylindrical sleeve in which plural magnets are arranged different in polarity from one another, is located adjacent to the surface of the photosensitive body, that fine magnetic particles are absorbed on the sleeve to form a magnetic brush, and that the magnetic brush is contactedly rotated an slid relative to the surface of the photosensitive body.

The one of the blade type is intended to eliminate the remaining particles of toner by pressing a blade, made of a resilient material, against the surface of the photosensitive body.

The one of the fur brush type is intended to eliminate the residual particles of toner by contactedly rotating and sliding a fur brush relative to the surface of the photosensitive body.

The magnetic brush type has a certain degree of cleaning capacity but it is insufficient for cleaning those particles of toner which are not transferred but left on the whole surface of the photosensitive body as a uniform black toner.

The blade type cannot achieve sufficient cleaning particularly in the case of the high speed copying machine and it is likely to damage the surface of the photosensitive body because its blade is constantly pressed against the surface of the photosensitive body.

Although the fur brush type can be used for the high speed copying machine, electric charge is introduced from a retrieval roll to the fur brush because bias voltages applied to the retrieval roll which serves to collect toner from the insulating fur brush are different from one another, and the potential difference between the retrieval roll and the surface of the fur brush is thus made negligible. As a result, the toner is not retrieved from the fur brush to the retrieval roll and the fur brush is jammed by the toner, thereby making the cleaning operation impossible. Further, the manner of making the fur brush of a conductive material, applying a bias voltage to it, and applying a higher bias voltage to the insulating retrieval roll has been proposed, but the same phenomenon as mentioned above is caused, making the cleaning operation insufficient.

For the purpose of enabling the fur brush type to have a stable cleaning capacity, it is needed that the resistance value of the fur brush itself is controlled to be within a specific range, that this resistance value is kept stable under any circumstances, and that the fur brush is made of a material which makes it hard to be physically deformed and which has a strong restoring force even if it is deformed. However, those conventional materials of which the brush was made could not meet all of these needs and accordingly, stable cleaning capacity could not be achieved.

SUMMARY OF THE INVENTION

The present invention is therefore intended to eliminate the above-mentioned drawbacks, and its object is to provide a cleaning device which has a stable cleaning capacity over a long time and under any circumstances.

According to the present invention, this object can be achieved by a cleaning device comprising a conductive fur brush for removing toner remaining on an image bearing member, a conductive collector roll, to which a predetermined bias voltage has been applied for retrieving the toner caught by the conductive fur brush, and a means for scraping the toner which has been retrieved onto the conductive retrieval roll.

DESCRIPTION OF THE PREFERRED EMBODIMENT

An embodiment of the present invention will be described referring to the accompanying drawings.

Figure 1:
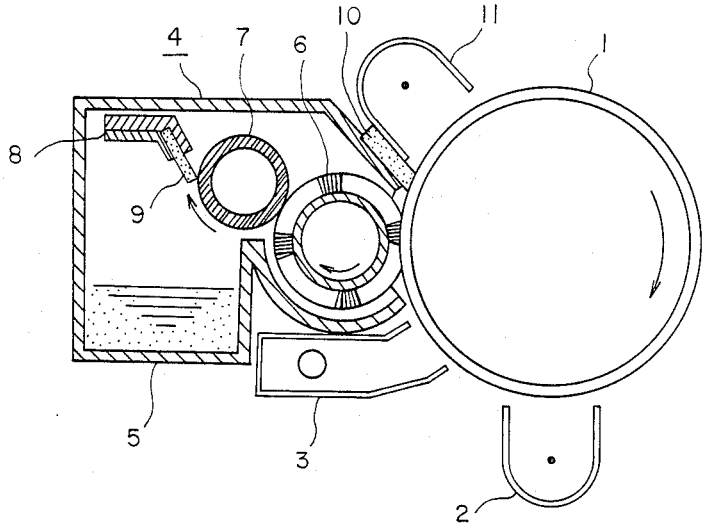
FIG. 1 is a sectional view showing the main portion of an embodiment of the present invention.

FIG. 1 is a sectional view showing the main portion of an example of the cleaning device according to the present invention.

A photosensitive drum 1 is rotated clockwise and after it is uniformly charged by a charging electrode 11, an image on an original is exposed by an exposing means (not shown) to form an electrostatic latent image on its surface. A developing means (not shown) then causes a toner to stick onto the electrostatic latent image to form a visible image. Thereafter, the visible image on the surface of the photosensitive drum 1 is transferred onto a sheet of paper (not shown) by means of a transferring electrode 2. After the photosensitive drum 1 is discharged by a discharging lamp 3, it is introduced into the cleaning section.

A cleaning device 4 of the present invention comprises a casing 5 whose opening faces the surface of the photosensitive drum 1, a conductive fur brush 6, a retrieval roll 7 made of metal and having a smooth surface, a blade 9 for scraping the toner, a holder 8 for holding the blade 9, and a shield member 10 located above the opening of the casing 5, said fur brush 5, retrieval roll 7, blade 9 and holder 8 being housed in the casing 5 and the casing 5 having a toner collecting space therein located under the point where the retrieval roll 7 and the blade 9 are contacted with each other.

In a case where the fur brush 6 has an outer diameter of $\phi$30 mm, for example, relative to the photosensitive drum 1 which rotates clockwise, the fur brush 6 can have a mechanical toner removing capacity when it is rotated clockwise, contactedly sliding on the surface of the photosensitive drum 1, provided that the length of its fiber is made 5 mm and that the length of its foremost end which contacts the surface of the photosensitive drum 1 is set from 1 to 2 mm. The number of brush rotation is preferably set in such a way that the ratio of brush's linear velocity relative to photosensitive drum's is larger than 1.0. In a case where the linear velocity of the photosensitive drum 1 is 125 mm/sec., that is, in the case of an electrophotographic copying machine wherein ten sheets and several sheets of originals which are of size A4 can be copied per minute for example, it is preferable to set the number of brush rotation larger than 80 rpm, provided that the fur brush has an outer diameter of 30 mm. The cleaning capacity can be enhanced as the number of brush rotation is increased, but when the fur brush is rotated at too high a speed, the particles of toner are undesirably scattered in the device. In order to enable sufficient cleaning to be achieved, rotating and sliding the conductive fur brush, to which a bias voltage has been applied and which is high in its fiber density, at a low speed under which the ratio of the velocity of the fur brush to that of the photosensitive drum 1 is kept more than 1.0, therefore, it is needed to have a fiber density larger than a predetermined value and a fiber arrangement resilient enough to keep its rotating and sliding force. As its fiber density is made higher, however, the falling-out of its fiber filaments becomes more remarkable and its fallen-out fiber filaments are scattered inside the device, which wrongly influences it. It is therefore needed that the brush fiber filament has a certain thickness which makes it difficult for the filament to snap while keeping the fiber density high, and that a manner of weaving the fiber filaments which makes it difficult for the woven filaments to fall out is employed.

Figure 2A:
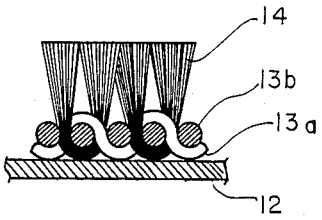
FIGS. 2A and 2B are sectional views showing arrangements of the brush.
Figure 2B:
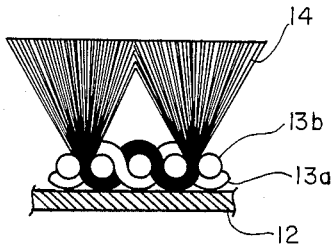

FIGS. 2A and 2B show arrangements of brush fiber wherein FIG. 2A shows V-weaving in which fur brush fiber filaments are woven in a letter V into a base cloth, while FIG. 2B W-weaving in which the fur brush fiber filaments 14 are woven in a letter W into the base cloth. Numeral 13*a* denotes a warp yarn while 13*b* a woof yarn, and these warp and woof yarns form the basic cloth. The fur brush fiber filaments 14 form a bundle, which is woven into the warp and woof yarns 13*a* and 13*b*. A metal pipe 12 is bonded to the basic cloth by a conductive bonding agent.

Figure 3:
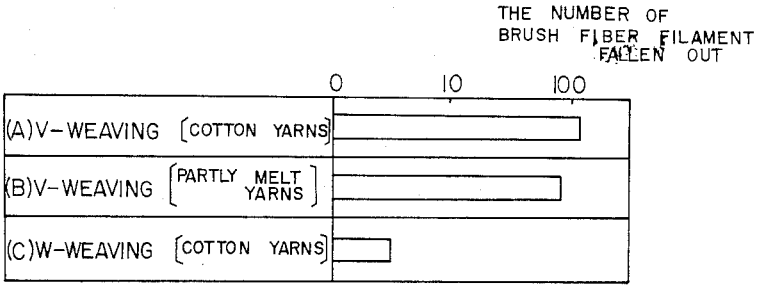
FIG. 3 shows the relationship between the manner of weaving the brush and the number of filaments shed.

FIG. 3 shows the result of tests conducted relating to the number of brush fiber filaments fallen out when the brush fiber filaments are woven according to the V- and W-weaving manners. Column (A) represents a case where fifty brush fiber filaments, each having a size of 6 deniers are woven as a bundle into a base cloth according to the V- weaving manner, cotton yarns whose surface is rough are used as warp and woof yarns, and the density of the brush fiber filaments is 180,000/inch$^2$; column B, a case where conditions are the same as those in column (A) except that several percentages of the cotton yarns which form the base cloth is replaced by melt yarns, the base cloth and the pipe are heat-sealed to strengthen the close adherence between the conductive pipe and the brush fiber, and column (C) a case where 300 brush fiber filaments each having a size of 5 deniers are bundled and woven into the base cloth, cotton yarns are used to form the base cloth, and the density of the brush fiber filaments is 190,000/inch$^2$.

The above-mentioned three types of fur brushes were set at the predetermined position in the machine respectively, and they were simulation-rotated for 8 hours without doing any corona charge, development, corona transfer and light charge removal. The number of fallen-out brush fiber filaments was more or less than 100 in any case in the columns (A) and (B), while it was less than 5 in the case of the column (C). It can be understood from the above that the wrong influence which is exerted upon the other sections by the fallen-out filaments is reduced to the greatest extent when the brush fiber is woven according to the W-weaving manner.

The size of each of the brush fiber filaments and their density under which the W-woven fur brush can be rotated at low speed to achieve high density brush cleaning will be described below.

Figure 4:
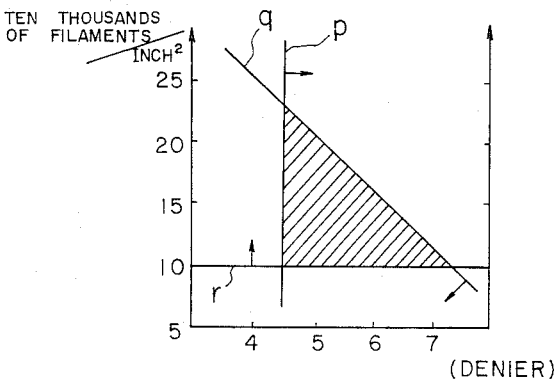
FIG. 4 is a graph showing the relationship between the size of a filament and the density of brush filaments.

FIG. 4 shows a case where the size of each brush fiber filament is changed from 4 to 8 deniers and the density of brush fiber filaments from 5/inch$^2$ to 250,000/inch$^2$, using a W-woven fur brush which has 300 brush fiber filaments per bundle. A straight line (p) in FIG. 4 denotes the limit of a brush fiber filament which is about to snap, and it can be recognized that no snap of filament is found in the right side area of the line (p), where the size of each of the brush fiber filaments is practically asked to be larger than 5 deniers. A straight line (q) represents the highest density of the brush fiber filaments which enables them to be woven, and the left lower side of the line (q) shows that area where they can be woven. A straight line (r) represents the limit of brush fiber filaments at which cleaning can be achieved rotating the fur brush at low speed (or from several ten to several hundred rotations per minute ), and the density is required to be higher than 100,000/inch$^2$ in the upper side area of the line (r). The number of the brush fiber filaments per bundle cannot be reduced too much, taking account of the weaving efficiency of the bundled brush fiber filaments per unit area, but a weaving density of 220,000/inch$^2$ can be sufficiently realized, providing that the number of the brush fiber filaments is 200 per bundle. When it exceeds 300 per bundle, the effect of weaving the bundled brush fiber filaments according to the W- weaving manner is reduced and the number of fallen-out filaments is increased undesirably. Therefore, the above teaches us that the condition under which low speed rotation and high density brush cleaning is enabled can be established when the size and the weaving density are selected and combined with each other from that shaded area which is enclosed by the three straight lines (p), (q) and (r) in FIG. 4, and when the fur brush is formed by setting the number of the brush fiber filaments from 200 to 300 per bundle and weaving these bundles into the base cloth.

Figure 5:
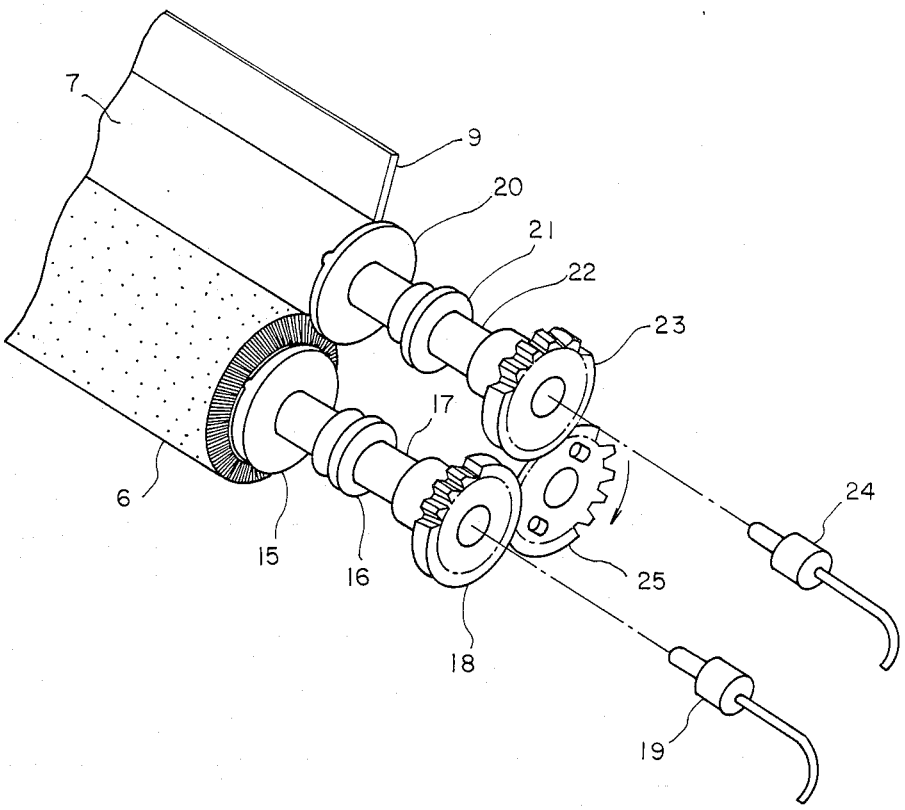
FIG. 5 is a perspective view showing the main portion of the present invention.

FIG. 5 is a perspective view showing a part of the cleaning device according to the present invention. The fur brush 6 of the present invention is adapted to have the functions of mechanically scraping and electrostatically sticking the toner.

As shown in FIGS. 2A and 2B, the conductive fur brush 6 comprises bonding bundles of the conductive brush fiber filaments 14 to the conductive pipe 12 to have electric conductivity. A conductive flange 15 is fitted onto the pipe 12 and a predetermined number of rotations is applied from a drive gear 25 to the pipe 12 through a pinion gear 18, a shaft 17 and a bearing 16. A first bias electrode 19 is further connected to the shaft 17 to apply a predetermined bias voltage to the fur brush 6. The retrieval roll 7 obtains a predetermined number of rotations from a drive gear 25 through a pinion gear 18 a shaft 22, a bearing 21 and a flange 20, and a predetermined second bias voltage is applied from a second bias electrode 24 to the retrieval roll 7.

Figure 6A:
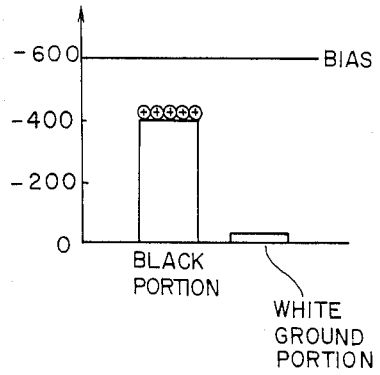
FIGS. 6A and 6B are characteristic views showing those relationships between potentials on the surface of a photosensitive body and bias voltages applied.
Figure 6B:
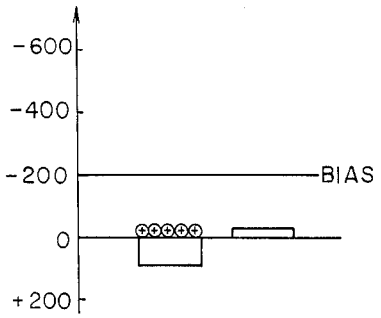
Figure 7:
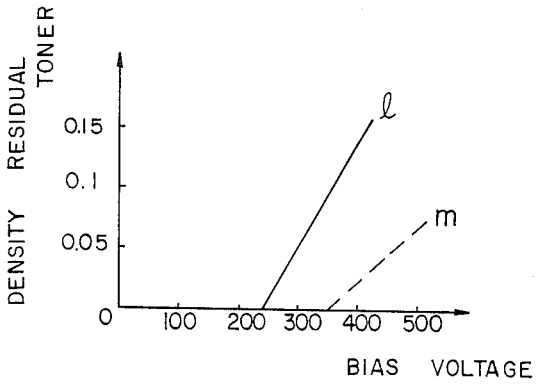
FIG. 7 is a characteristic view showing the relationship between the bias voltages applied and the density of residual toner.

FIGS. 6A and 6B show the relationship between potentials at the not-transferred and still remaining toner portion and at the white ground portion on the photosensitive drum 1 and bias voltages applied to the fur brush 6. FIG. 6A represents a case where no charge removal is applied to the photosensitive drum 1 just before the cleaning operation, wherein high potential of about −400 V remains at the not-transferred and still remaining toner portion and wherein first bias voltage of about −600 V is needed to electrically collect the residual toner of positive polarity by means of the fur brush. In this case, the difference between potentials at the still remaining toner portion and at the white ground portion becomes large and current flows to the photosensitive drum 1 through the brush fiber filaments, so that toner particles can adhere reversely to the photosensitive drum 1. FIG. 6B shows a case where the photosensitive drum 1 is subjected to light-discharging treatment just before the cleaning operation. FIG. 7 shows densities of residual toner particles (or those at poor, cleaning) measured after the photosensitive drum 1 passes through the cleaning section, keeping variable the first bias voltage which is applied to the fur brush, in the case where the light-discharging treatment is applied just before the cleaning operation, wherein a straight line (l) denotes poor cleaning densities at the not-transferred and still remaining toner portion while a straight line (m) denotes those at the white ground portion. When the bias voltage is made high even in the case of applying the light-discharging treatment like this, poor cleaning results. For the purpose of keeping the cleaning capacity stable therefore, it is desirable that the first bias voltage which is applied to the fur brush 6 is set lower than −250 V, preferably from 0 to −200 V in the case of positive polarity toner. Further, it is naturally needed that the second bias voltage which is applied to the retreival roll 7 is made substantially different from the first bias voltage which is applied to the fur brush 6, in order to let the retreival roll 7 have stronger electrostatic suction force relative to toner particles adhering to the fur brush 6, but when this difference is made too large, the substantial potential of the fur brush 6 is raised, so that the above-mentioned toner-reversely-adhering phenomenon may result. It is therefore effective that this difference of voltage is set lower than 500 V, preferably from 200 to 400 V. When the first bias voltage is set −200 V, for example, it is effective that the second bias voltage is set from −400 to −600 V.

Figure 8:
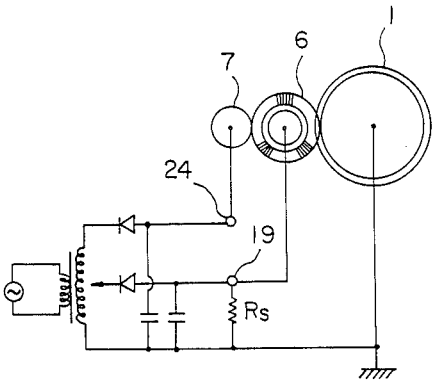
FIG. 8 shows an example of the bias power source circuit acccording to the present invention.

FIG. 8 is a sketch showing a bias power source circuit embodied by the present invention. Intermediate tap is adapted to obtain an output of −100 V from the first bias electrode 19 and an output of −500V from the second bias electrode 24. Rs in FIG. 8 represents a grounded resistor of 1MΩ which is arranged between the first bias electrode 19 and the earth. This grounded resistor Rs is intended to suppress both of currents flowing from the second bias electrode 24 to the photosensitive drum 1 through the retreival roll 7 and the fur brush 6 and flowing from the first bias electrode 19 to the photosensitive drum 1 through the fur brush 6.

In a case where no grounded resistor Rs is added and where a brush material whose resistance value is reduced to a greater extent under high humidity is employed, current flows corresponding to the potential difference between the retreival roll 7 and the fur brush 6, thereby finally making the potential difference negligible. Further, in a case where a resistor whose resistance value is larger than that of the rotating fur brush is used, the magnitude of registor's bias voltage which is generated by current flowing to the grounded resistor Rs itself exceeds the first bias voltage, so that the potential of the retreival roll 7 can not be made different from that of the fur brush 6. In addition, most of current flowing through the circuit passes through the photosensitive drum 1, causing the surface of the photosensitive drum 1 to be made unclean by the reversely-adhering phenomenon of toner, and the photosensitivity thereof to be deteriorated.

When a resistor which has a resistance value equal to or smaller than that of the rotating brush material is employed as the grounded resistor Rs, therefore, a stable and steady current circuit can be realized and the potential difference can usually be made stable between the retreival roll 7 and the fur brush 6 accordingly.

The quality of fur brush material which is an important factor in achieving the brush cleaning system of the present invention will be described.

The fur brush cleaning system of the present invention comprises applying the first bias voltage to the conductive fur brush 6, electrostatically collecting the toner from the photosensitive drum 1, applying the second bias voltage to the conductive collector roll 7 which is rotating in contact with the fur brush 6, and electrostatically collecting the toner from the fur brush 6. For the purpose of keeping this cleaning system stable, it is needed at first that the fur brush 6 is stably and sufficiently contacted with the photosensitive drum 1 and that the fur brush 6 is also stably and sufficiently contacted with the retreival roll 7. Secondly, the resistance value of the fur brush 6 itself must be controlled within a specific range and this resistance value must be stable under any circumstances and relative to any change in humidity.

Figure 9:
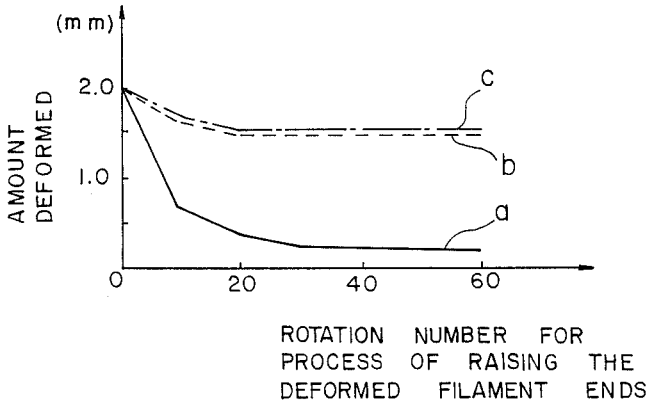
FIG. 9 is a characteristic view showing the restoring forces of brush materials obtained when they are deformed.

FIG. 9 is a graph showing how the deformed foremost ends of fiber filaments recover, depending upon the different materials from which the fur brush is made. A brush which had an outer diameter of $\phi$30 mm and a length of 5.0 mm was located against a metal retreival roll of $\phi$20 mm in such a way that the length of the former's fiber filaments which were contacted with the latter was 2.0 mm, and they were left as they were for 100 hours at a temperature of 45° C. and a humidity of 85%. Thereafter, it was measured how much the brush had recessed from its outer circumferential dimension and the change in the amount deformed, that is, the recovery of its deformed filament ends was then checked, rotating it together with the collector roll. (a) in FIG. 9 represents the recovery of deformed filament ends of a brush which was made of "Rec-D" (trademark) by Unichika Corporation by dispersing carbon in rayon material and making it conductive; (b) that of deformed filament ends of a brush which was made of "Beltron" (trademark) by Kanebo Corporation by dispersing carbon in acryl material; and (c) that of deformed filament ends of a brush which was made of "Megar" (trademark) by Unichika Corporation by dispersing carbon in nylon material. As apparent from FIG. 9, no recovery of deformed filament ends could be found and they were left deformed even after the process of raising the deformed filament ends was carried out rotating the brushes together with the retreival roll, in the cases (b) and (c) where the brushes were made of acryl and nylon materials respectively, which were synthetic fibers. In the case (a) where the brush was made of rayon material which was regenerated fiber, however, the deformed filament ends were recovered to their original outer circumferential dimension after several rotations of the brush together with the retreival roll were made to raise the deformed filament ends, although they were left a little deformed from their original outer circumferential dimension.

In the case of the fur brush of the bias impression type which is characterized by its very small diameter and short filament length such as $\phi$30 mm and 5.0 mm, therefore, its filament ends are likely to be deformed, but the regenerated fiber such as rayon can recover at once even after it is deformed. It has therefore been found necessary to select a material which has a strong recovering capacity such as rayon.

Under usual circumstances, "Rec-D" has a resistivity ranging from $10^7$ to $10^9$ Ωcm. When the brush which had a density of 180,000/inch$^2$, a brush filament length of 5 mm, and a longitudinal brush dimension of 260 mm was made of "Rec-D" and the length of brush filaments which were contacted with the retreival roll was from 1.0 to 2.0 mm, the resistance of the brush was $10^7$ Ωcm at the time of rotation, but when it was measured, changing the circumstances, it was found that it depended very strongly upon humidity.

"Rec-D" showed a resistance value of from 50 MΩ to 100 ΩM at the time of brush rotation and under the circumstances of usual temperature and humidity, and this is a good bias effect. When the values of the first and second bias voltages were set −100 V and −200 V, respectively, and the surface potential of the brush was measured, it ranged from −200 to −300 V. Providing that the grounded resistor Rs in FIG. 8 was set 1 MΩ, this teaches us that those potential differences between the photosensitive drum 1 and the fur brush 6 and between the fur brush 6 and the retreival roll 7 were set substantially ideal. It is practically confirmed that excellent toner retreival is achieved, causing the brush not to be jammed with the toner and enabling the toner to be retreived reliably.

When the circumstance conditions were changed to 30° C. and 80%, however, the resistance value of the brush material became 0.2 MΩ–0.3 MΩ lower than 1 MΩ. In the case of the fur brush cleaning system of the bias impression type, a bias voltage of about −500 V is applied to the retreival roll 7 and the grounded resistor Rs is previously selected 1 MΩ. Therefore, the value of current flowing to the brush is larger than 400 μA and a voltage of about −400 V is produced as self-bias voltage in the grounded resistor Rs. As a result, the potential difference between the retreival roll 7 and the fur brush 6 is reduced not to retreive the toner and when the resistance value of the brush material becomes smaller than 1 MΩ, the value of current flowing to the photosensitive drum 1 is increased, causing the surface of the photosensitive drum 1 to be electrostatically charged by the fur brush 6. In addition, then-flowing current weakens the charge of residual toner particles which are to be cleaned, and it also causes the polarity of the residual toner particles to be reversed. Therefore, instead of their being cleaned, the remaining toner particles repel the fur brush 6 and adhere onto the photosensitive drum 1 again. In short, the phenomenon of their reversely adhering onto the photosensitive drum and making the surface of the drum unclean results.

When the circumstance conditions change to low temperature of 5° C. and low humidity of 30%, the resistance value becomes 500 MΩ even at the starting time and it becomes high, 2000 MΩ, after continuous rotation over one hour. When this happens, the brush comes to serve as an insulating member and stores charge. As the result, the potential difference between the retreival roll 7 and the fur brush 6 becomes smaller and smaller and the toner particles held by the fur brush 6 cannot be retreived onto the retreival roll 7, thereby causing the fur brush to be jammed with the toner particles and making the cleaning operation insufficient.

The reasons why the resistance value depends strongly upon humidity like this are supposed that the brush becomes low in resistance at the time of high humidity due to its hygroscopic property since rayon is water-absorptive in its quality, and that the brush becomes high in resistance because of its heating and water-repelling action caused by sliding frictional heat at the time of its rotation when continuous copying operation is carried out.

Various measures were tried to add a property, which can keep the resistance value unchanged to the greatest extent even when humidity changes, to rayon material which has various advantages as described above. As a result, it has been found that the hygroscopicity of rayon can be eliminated by replacing OH-radical of cellulose, which forms rayon, with a hydrophobic one, because OH-radical of cellulose participates in the hygroscopicity of rayon.

Figure 10A:
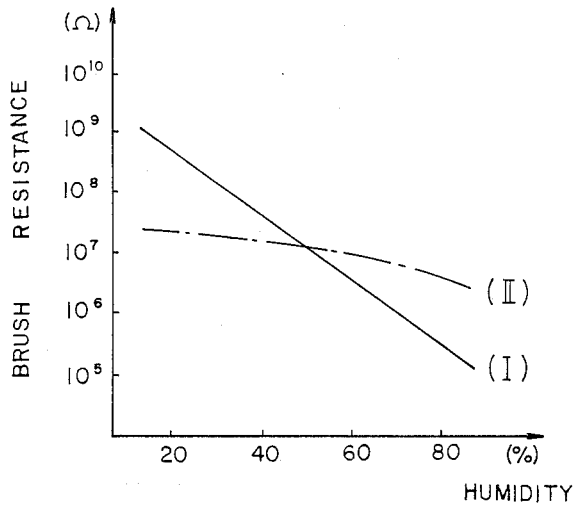
FIGS. 10A and 10B are characteristic views showing changes in the resistance value of brush materials responsive to a humidity change and showing changes in the resistivity of brush materials responsive to the humidity change when they are stranded.
Figure 10B:
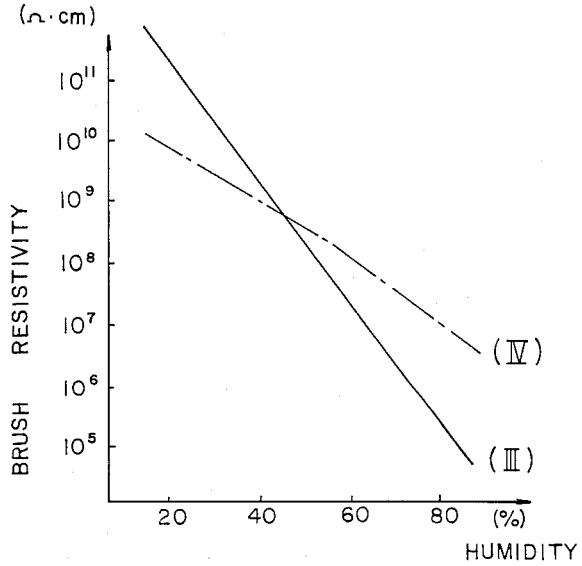

FIG. 10A shows resistance values of brush materials obtained when brushes are rotating, while FIG. 10B shows resistivities of brush fibers obtained when they are in the form of filaments.

Curves (I) and (III) in FIGS. 10A and 10B represent those in the case of "Rec-D", wherein the resistance value of the brush material changes by more than 3 orders at the times of low and high humidities and this is unpractical. Curves (II) and (IV) represent those in the case where OH-radicals of rayon are subjected to hydrophobic treatment. The resistivity can be held from $10^7$ to $10^{10}$ Ωcm within a humidity range of 20–80% and this is about half that of "Rec-D" itself. In addition, the resistance value of the brush material changes only from $10^6$ Ωcm to $10^7$ Ωcm when humidity changes from 20 to 80%, that is, the change of the resistance value can be held in the order of one. It is therefore possible to make a brush which has an excellently stable resistance value. When the cleaning efficiency was actually checked, using this brush material, it was confirmed that stable cleaning operation could be held under the circumstance conditions of from 5° C. and 30% to 35° C. and 85%.

In a case where a conductive fur brush which is made of this brush material, stable under any circumstances, is employed, it may be arranged that the conductive fur brush is directly grounded without using the grounded resistor shown in FIG. 8. Since the resistance value of the brush hardly depends upon the circumstances, the conductive fur brush can have a substantiall stable potential owing to its charge introduced from the retreival roll. When the conductive fur brush which is made of conductive hydrophobically-treated rayon is directly grounded, a bias voltage of −400 V is applied to the retreival roll, and the circumstance conditions change from 5° C. and 30% to 35° C. and 85%, for example, it has been found that the potential of the conductive fur brush can be kept within a range of from −50 to −200 V and that no problem is caused in achieving the cleaning operation.

As described above, the present invention enables residual toner particles to be cleaned stably and efficiently under any circumstances.

What is claimed is:

1. A cleaning apparatus comprising a conductive fur brush and means for directly grounding said fur brush, said brush comprising a conductive material having a resistivity of $10^7$–$10^{10}$ ohm-cm. for removing residual toner from an image bearing member, said cleaning apparatus further comprising a conductive retrieval roll and means for applying a predetermined bias voltage to said roll, said conductive retrieval roll comprising means for retrieving toner caught in said fur brush, said apparatus further comprising means for scraping toner which has been transferred to said conductive retrieval roll from said retrieval roll.

2. A cleaning apparatus in accordance with claim 1 wherein said conductive fur brush has a resistance of $10^6$–$10^8$ ohms when said conductive fur brush is rotated.

3. A cleaning apparatus in accordance with either of claims 1 or 2 wherein said conductive material forming said conductive fur brush is hydrophobic.

4. A cleaning apparatus comprising a conductive fur brush grounded through a predetermined resistance, said apparatus further comprising means for applying a bias voltage to said brush, said bias voltage having a polarity which is opposite to the polarity of the bias voltage of electrostatically charged toner remaining on an image bearing member, said conductive fur brush thereby comprising means for removing said toner from said image bearing member, said cleaning apparatus further comprising a conductive retrieval roll and means for applying a bias voltage to said conductive retrieval roll of a polarity opposite to the polarity of said electrostatically charged toner removed from said image bearing member, said conductive retrieval roll thereby comprising means for retrieving toner caught in said fur brush, and means for scraping toner transferred to said conductive retrieval roll, wherein the bias voltage applied to said conductive fur brush has an absolute value of less than 200 volts and the absolute value of the bias voltage applied to said conductive retrieval roll is greater than the absolute value of the bias voltage applied to said conductive fur brush by between 200 and 500 volts.

5. A cleaning apparatus comprising a conductive fur brush grounded through a predetermined resistance, said apparatus further comprising means for applying a bias voltage to said brush, said bias voltage having a polarity which is opposite to the polarity of the bias voltage of electrostatically charged toner remaining on an image bearing member, said conductive fur brush thereby comprising means for removing said toner from said image bearing member, said cleaning apparatus further comprising a conductive retrieval roll and means for applying a bias voltage to said conductive retrieval roll of a polarity opposite to the polarity of said electrostatically charged toner removed from said image bearing member, said conductive retrieval roll thereby comprising means for retrieving toner caught in said fur brush, and means for scraping toner transferred to said conductive retrieval roll, wherein the resistance connected to said conductive fur brush has a value lower than the resistance of said rotating conductive fur brush.

6. A cleaning apparatus in accordance with claim 4 wherein the resistance connected to said conductive fur brush has a value lower than the resistance of said rotating conductive fur brush.

7. A cleaning apparatus in accordance with any one of claims 4, 5 or 6, said conductive fur brush comprising conductive material having a resistivity of $10^7$–$10^{10}$ ohms-cm.

8. A cleaning apparatus in accordance with any one of claims 4, 5 or 6, said conductive fur brush having a resistance of $10^6$–$10^8$ ohms when said conductive fur brush is rotated.

9. A cleaning apparatus in accordance with claim 8 wherein said conductive fur brush comprises a hydrophobic conductive material.

10. A cleaning apparatus in accordance with claim 7 wherein said conductive fur brush comprises a hydrophobic conductive material.

11. A cleaning apparatus in accordance with claim 8 wherein said conductive fur brush comprises conductive rayon.

12. A cleaning apparatus in accordance with claim 9 wherein said conductive fur brush comprises conductive rayon.

13. A cleaning apparatus comprising a conductive fur brush grounded through a predetermined resistance, said apparatus further comprising means for applying a bias voltage to said brush, said bias voltage having a polarity which is opposite to the polarity of the bias voltage of electrostatically charged toner remaining on an image bearing member, said conductive fur brush thereby comprising means for removing said toner from said image bearing member, said cleaning apparatus further comprising a conductive retrieval roll and means for applying a bias voltage to said conductive retrieval roll of a polarity opposite to the polarity of said electrostatically charged toner removed from said image bearing member, said conductive retrieval roll thereby comprising means for retrieving toner caught in said fur brush, and means for scraping toner transferred to said conductive retrieval roll, said conductive fur brush having a resistance of $10^6$–$10^8$ ohms when said conductive fur brush is rotated.

14. A cleaning apparatus comprising a conductive fur brush grounded to a predetermined resistance, said apparatus further comprising means for applying a bias voltage to said brush, said bias voltage having a polarity which is opposite to the polarity of the bias voltage of electrostatically charged toner remaining on an image bearing member, said conductive fur brush thereby comprising means for removing said toner from said cleaning apparatus further comprising a conductive retrieval roll and means for applying a bias voltage to said conductive retrieval roll of a polarity opposite to the polarity of said electrostatically charged toner removed from said image bearing member, said conductive retrieval roll thereby comprising means for retrieving toner caught in said fur brush, and means for scraping toner transferred to said conductive retrieval roll, said conductive fur brush comprising conductive material having a resistivity of $10^7$–$10^{10}$ ohms-cm.

* * * * *

UNITED STATES PATENT AND TRADEMARK OFFICE

CERTIFICATE OF CORRECTION

PATENT NO. : 4,755,853

DATED : July 5, 1988

INVENTOR(S) : Shigeru SHIMIZU et al.

It is certified that error appears in the above-identified patent and that said Letters Patent is hereby corrected as shown below:

At column 5, line 35, delete "," after "poor" and before "cleaning".

At column 5, line 12, insert ---,--- after "18" and before "a".

At column 5, line 51, change "retreival" to ---retrieval---.

At column 5, line 53, change "retreival" to ---retrieval---.

At column 6, line 4, change "retreival" to ---retrieval---.

At column 6, line 11, change "retreival" to ---retrieval---.

At column 6, line 18, change "retreival" to ---retrieval---.

At column 6, line 19, insert ---the--- after "of" and before "current".

At column 6, line 30, change "retreival" to ---retrieval---.

At column 6, line 32, insert ---fur--- after "the" and before "brush".

At column 6, line 45, change "retreival" to ---retrieval---.

At column 6, line 55, change "retreival" to ---retrieval---.

At column 7, line 9, change "retreival" to ---retrieval---.

At column 7, line 16, change "retreival" to ---retrieval---.

UNITED STATES PATENT AND TRADEMARK OFFICE

CERTIFICATE OF CORRECTION

PATENT NO. : 4,755,853

DATED : July 5, 1988

INVENTOR(S) : Shigeru SHIMIZU et al.

It is certified that error appears in the above-identified patent and that said Letters Patent is hereby corrected as shown below:

At column 7, line 33, change "retreival" to ---retrieval---.

At column 7, line 39, change "rm" to ---mr---.

At column 7, line 48, change "retreival" to ---retrieval---.

At column 7, line 50, change "retreival" to ---retrieval---.

At column 7, line 52, change "retreival" to ---retrieval---.

At column 7, line 58, change "retreival" to ---retrieval---.

At column 7, line 63, change "retreival" to ---retrieval---.

At column 7, line 64, change "retreive" to ---retrieve---.

At column 8, line 17, change "retreival" to ---retrieval---.

At column 8, line 19, change "retreival" to ---retrieval---.

At column 8, line 19, change "retreival" to ---retrieval---.

At column 9, line 1, change "substantiall" to ---substantial---.

UNITED STATES PATENT AND TRADEMARK OFFICE

CERTIFICATE OF CORRECTION

PATENT NO. : 4,755,853

DATED : July 5, 1988

INVENTOR(S) : Shigeru Shimizu, et al

It is certified that error appears in the above-identified patent and that said Letters Patent is hereby corrected as shown below:

At column 9, line 2, change "retreival" to --retrieval--.

At column 9, line 6, change "retreival" to --retrieval--.

Signed and Sealed this

Fourteenth Day of August, 1990

*Attest:*

HARRY F. MANBECK, JR.

*Attesting Officer*

*Commissioner of Patents and Trademarks*